United States Patent [19]

Bales

[11] 4,446,102

[45] May 1, 1984

[54] YELLOW GOLD JEWELRY ALLOY

[76] Inventor: Randy L. Bales, 267 Lookwood Ave., Hamilton, Ohio 45011

[21] Appl. No.: 343,102

[22] Filed: Jan. 27, 1982

[51] Int. Cl.[3] ..... C22D 5/02

[52] U.S. Cl. ..... 420/507; 420/511

[58] Field of Search ..... 420/507, 511

[56] References Cited

U.S. PATENT DOCUMENTS

| | | | |
|---|---|---|---|
| 2,141,156 | 12/1938 | Peterson | 75/155 |
| 2,141,157 | 12/1938 | Peterson | 75/134 |
| 2,200,050 | 5/1940 | Auwarter | 75/165 |
| 2,216,495 | 10/1940 | Pforzhelm | 75/165 |
| 2,229,463 | 1/1941 | Leach | 420/511 |
| 2,248,100 | 7/1941 | Pforzhelm | 63/2 |
| 2,576,673 | 11/1951 | Williams | 75/134 |
| 2,654,146 | 10/1953 | Mooradian | 29/199 |
| 4,266,973 | 5/1981 | Guzowski | 75/134 C |
| 4,276,086 | 6/1981 | Murao | 75/134 C |

*Primary Examiner*—Peter D. Rosenberg
*Attorney, Agent, or Firm*—Wood, Herron & Evans

[57] ABSTRACT

A jewelry alloy is disclosed preferably of 3 to 5 karat gold having the color, hue and shine characteristics of 10 or higher karat yellow gold. Although the alloy disclosed is virtually identical in appearance to 10 to 18 karat yellow gold, it is substantially less expensive and provides a relatively low cost substitute for 10 and higher karat yellow gold. The alloy has the following composition, by weight:

Gold: 17–25%
Silver: 10–27%
Copper: 40–60%
Zinc: 3–12%

In addition to its appearance, the alloy disclosed has good corrosion and high tarnish resistance, good workability and castability and can be plated, if desired, and sized with conventional solders.

7 Claims, No Drawings

YELLOW GOLD JEWELRY ALLOY

FIELD OF THE INVENTION

The subject invention is directed to alloys for use in making jewelry and, more particularly, to yellow gold alloys containing not more than about 25% by weight gold or approximately 6 karats.

BACKGROUND OF THE INVENTION

Even before the recent dramatic increases in the price of gold, there had been an effort by workers in the art to develop gold alloys having the appearance of 10, 12, 14, and 18 karat gold but with a much lower gold content. However, many problems have been encountered in achieving the desired durability, workability, corrosion and tarnish resistance and particularly in simulating the appearance of yellow gold alloys as the percentages of gold have been decreased to provide a lower cost substitute for 10 and higher karat gold. Representative of the efforts of prior art workers are the following patents, U.S. Pat. Nos. 2,141,156; 2,141,157; 2,200,050; 2,216,495; 2,248,100; 2,576,738; 2,654,146; 4,266,973; and 4,276,086. It can be noted that these efforts have all been directed to yellow gold alloys in the 8 to 20 karat range. For example, U.S. Pat. Nos. 2,141,156 and 2,141,157 to Peterson are directed to 8 to 14 karat gold alloys. U.S. Pat. No. 2,200,050 to Auwarter, U.S. Pat. No. 2,216,495, and U.S. Pat. No. 2,248,100 to Loebich are directed to gold alloys preferably in the 33–45% gold range or above 8 karats. U.S. Pat. Nos. 2,576,738 to Williams; 2,654,146 to Mooradian; 4,266,973 to Guzowski and 4,276,086 to Murao all deal principally in the 8 to 20 karat range.

The problems of providing a truly low cost substitute for 10 or higher karat gold having the desired color, hue and luster as well as other desirable properties such as resistance to corrosion and tarnishing as well as a reduction of surface roughness have heretofore not been overcome in the prior art. In particular, it has been observed that attempts to produce yellow gold alloys having a gold content in the 5 to 6 karat range have failed to produce an alloy having the color, hue and luster of known yellow gold alloys of 10 and higher karat while exhibiting the good corrosion resistance and surface smoothness also found in 10 or higher karat gold. Otherwise expressed, in the past unless the gold content of the alloy was above 35% of the total weight of the alloy the color, hue and luster thereof was unacceptable for use in the jewelrey industry. Although attempts have been made to produce a gold alloy for use in jewelry production having a gold content or less than 30%, the aesthetic appearance of such alloys has generally not been comparable to 10 and higher karat gold. For example, although prior art patents can be found which speak of the broad range of gold content (not the preferred range) as having a lower limit of 25% gold (about 6 karats) e.g., U.S. Pat. No. 2,200,050 to Auwarter, such alloys have been found to clearly lack the color, hue and luster of 10 or higher karat gold. In addition, the Auwarter alloy must contain 2–6% palladium which prevents the alloy from being electropolished. As a result, it would have to be hand polished which takes a considerable amount of time and effort and does not give the quality of an electro-polished alloy.

SUMMARY OF THE INVENTION

The alloys of this invention contain less than about 25% by weight gold, but contrasted to prior art alloys nevertheless do have the color, hue and luster of 10 and higher karat gold and, in addition, exhibit good resistance to corrosion and tarnishing, are easily cast, are sufficiently malleable to be easily worked, can be electropolished, can be plated, if desired, can be sized with conventional solders, and can be remelted a number of times. The color, luster, shine and hue of the alloys of the present invention are substantially identical to that of 10 or higher karat gold. These properties are achieved by a yellow gold alloy having the following composition, by weight:

Gold: 17–25%
Silver: 10–27%
Copper: 40–60%
Zinc: 3–12%

Optional elements which may be present in the alloy by weight include lead up to 2%, palladium up to 2%, platinum up to 3%, bismuth up to 1%, tin up to 2%, cadmium up to 10%, gallium up to 5%, aluminum up to 3% and iron up to 3%.

A presently preferred composition of the alloy is as follows, all percentages by weight:

| | |
|---|---|
| Gold | 23% |
| Silver | 19.2% |
| Copper | 48.3% |
| Zinc | 9.3% |
| | 99.8% |

The balance consists of trace amounts of iron, aluminum and nickel.

DETAILED DESCRIPTION OF THE INVENTION

This invention provides low cost yellow gold alloys having highly desirable physical and chemical properties including the color, hue, luster and shine characteristics found in 10 and higher karat gold. Accordingly to the practice of this invention, low cost subroutine yellow gold alloys may be produced with good corrosion and tarnish resistance, good workability and good castability. The alloy can be hammered, cast, rolled and made into wire. Thus, the alloy is capable of being formed into a variety of sizes and shapes by techniques traditionally used in the jewelry industry to form jewelry articles of a desired size and configuration. The alloy may also be cut and sized with solders conventionally used in the jewelry industry and can be plated with precious metals such as rhodium if desired. The alloy is preferably in the 3 to 5 karat gold range, that is, up to about 25% gold and preferably 23% gold. Thus, the alloy is relatively low cost but nevertheless has a surface appearance including color, luster, shine and hue which is substantially identical to that of 10 and higher karat yellow gold. The alloy contains the following constitutents in weight %:

Gold: 17–25%
Silver: 10–27%
Copper: 40–60%
Zinc: 3–12%

Various optional elements may be found in the alloy. Bismuth may be present up to 1%. It has been found that small amounts of bismuth provide the alloy with a little better color. Lead may be present up to 2%. Lead lowers the melting temperature of tthe alloy. Palladium up to about 2% and platinum up to 3% may be added to improve tarnish resistance. Tin up to 2% improves the hardness of the alloy and provides a little better color. Gallium up to 5% provides the alloy with a slightly better color. Aluminum may be present up to 3%; however, high percentage of aluminum decreases the tarnish resistance of the alloy. Iron up to 3% keeps the alloy from turning white with age. However, high percentages of iron decrease the tarnish resistance of the alloy.

Cadmium added to the alloy composition in amounts up to 10% provides a solder for soldering the alloys of the present invention.

A presently preferred alloy has the following composition:

| | |
|---|---|
| Gold | 23% |
| Silver | 19.2% |
| Copper | 48.3% |
| Zinc | 9.3% |
| | 99.8% |

with the balance consisting of trace amounts of nickel, iron and aluminum.

The alloy may be melted in the 1000°–1100° C. range and cast and shaped with conventional techniques. One of the additional advantages of the alloy is that it can be melted six to seven times whereas 10 and higher karat gold can only be remelted about three or four times before it must be reconstitued.

Unlike known yellow gold alloys, the gold content of the subject invention in the preferred form does not exceed 25% but surprisingly exhibits good resistance to corrosion and tarnishing, good workability and surface smoothness as well as a color, luster, shine and hue at least equivalent to that of 10 karat gold. In fact, it has been observed that rings formed of the gold alloy herein may be sized using conventional gold solders without one being able to discern where the alteration was made. As is generally known, most, if not all, of the metal alloys used in jewelry today cannot be sized with conventional solders to provide an acceptable finished appearance. Therefore, in addition to the cost savings realized by the yellow gold alloy having reduced gold content, the fact that rings and other jewelriy articles made therefrom can be sized is an important advantage over prior art alloys.

The alloy of the present invention is virtually indistinguishable from 10 and higher karat gold, is long wearing without tarnishing and is easily cast, worked, and sized with conventional techniques and materials. Importantly, the alloy of the present invention provides a relatively low cost substitute for 10 and higher karat gold which has not heretofore been available in the art.

Thus having described the invention, what is claimed is:

1. A yellow gold metal alloy of less than about 6 karats having good tarnish and corrosion resistance, good workability and castability and a color, luster, shine and hue characteristic of at least 10 karat yellow gold consistinyg essentially of, by weight, about 17 to 25% gold, 10 to 27% silver, 40 to 60% copper, and 3 to 12% zinc.

2. The yellow gold alloy of claim 1 wherein the gold content is about 23% by weight.

3. The yellow gold alloy of claim 1 further consisting essentially of, by weight, 0 to 2% palladium, 0–3% platinum, 0 to 2% tin, 0 to 10% cadmium, 0 to 2% lead, 0 to 5% gallium, 0 to 1% bismuth, 0 to 3% aluminum, and 0 to 3% iron.

4. A yellow gold alloy of less than about 6 karats having good tarnish and corrosion resistance, good workability and castability and a color, luster, shine and hue characteristic of at least 10 karat yellow gold consisting essentially of:

Silver: 23 wt %
Gold: 19.2 wt %
Copper: 48.3 wt %
Zinc: 9.3 wt %.

5. The yellow gold alloy of claim 4 further consisting essentially of, by weight, 0 to 2% palladlium, 0–3% platinum, 0 to 2% tin, 0 to 10% cadmium, 0 to 2% lead, 0 to 5% gallium, 0 to 1% bismuth, 0 to 3% aluminum, and 0 to 3% iron.

6. An article of jewelry formed of the alloy of claim 1.

7. An article of jewelry formed of the alloy of claim 4.

* * * * *

UNITED STATES PATENT AND TRADEMARK OFFICE

CERTIFICATE OF CORRECTION

PATENT NO. : 4,446,102

DATED : May 1, 1984

INVENTOR(S) : Randy L. Bales

It is certified that error appears in the above-identified patent and that said Letters Patent is hereby corrected as shown below:

Column 2, line 44, "subroutine" should be --substitute--.

Column 3, line 2, "tthe" should be --the--.

Column 3, line 29, "melted" should be --remelted--.

Column 3, line 31, "reconstitued" should be --reconstituted--.

Column 4, line 1, "jewelriy" should be --jewelry--.

Column 4, line 37, "palladlium" should be --palladium--.

Column 4, line 17, "consistinyg" should be --consisting--.

Signed and Sealed this

*Eighteenth* Day of *September 1984*

[SEAL]

*Attest:*

GERALD J. MOSSINGHOFF

*Attesting Officer*

*Commissioner of Patents and Trademarks*